US005605020A

United States Patent [19]

Chambers

[11] Patent Number: 5,605,020

[45] Date of Patent: Feb. 25, 1997

[54] ROOFING TERMINATION DEVICE

[75] Inventor: Alan Chambers, Glendale, Ariz.

[73] Assignee: The Garland Co., Inc., Cleveland, Ohio

[21] Appl. No.: 464,105

[22] Filed: Jun. 5, 1995

[51] Int. Cl.[6] ..... E04D 1/36; E04D 13/14

[52] U.S. Cl. ..... 52/58; 52/60; 52/300; 52/396.04; 52/409; 52/411

[58] Field of Search ..... 52/58, 96, 409, 52/411, 396.04, 60, 300

[56] References Cited

U.S. PATENT DOCUMENTS

| | | | |
|---|---|---|---|
| 3,256,650 | 6/1966 | Weckerly et al. | 52/58 |
| 3,346,941 | 10/1967 | Patry et al. | 52/396.04 X |
| 4,483,112 | 11/1984 | Rueblinger | 52/58 X |
| 4,619,100 | 10/1986 | Emblin . | |
| 4,685,256 | 8/1987 | Alkjaer | 52/58 |

OTHER PUBLICATIONS

"The NRCA Roofing and Waterproofing Manual". 3rd edition, 1989. pp. 3,4,8,11.

"Sweet's Industrial Construction and Renovation, 1993 Catalog File". pp. 07500/Man and 07710/Man.

*Primary Examiner*—Christopher T. Kent

*Attorney, Agent, or Firm*—Oldham & Oldham Co. L.P.A.

[57] ABSTRACT

A device lot terminating a roof surface at a vertical edge In a waterproof and airtight manner may serve as a flashing strip at a parapet wall, a wall cap, a roof edge, an expansion joint or in other roofing applications. The device comprises a relatively rigid member, typically of sheet metal or the like, and a flexible member, typically of modified coal tar bitumen, EPDM, or other suitable roofing material. The device has a channel formed in the rigid member along a longitudinal edge that receives the flexible member in an airtight and watertight manner. In this configuration, the flexible member provides a covering for the fastening surface on the rigid member, which is fastened by conventional means to the roofing surface and the underlying support structure. The preferred channel is formed from a pair of longitudinal bends made in opposite directions such that a "Z" shape cross section is formed. The edge of the flexible member is coated with an appropriate sealant, positioned into the channel and compressed into place. In some applications, at least one portion of the first member near the first bend forming the "Z" shape cross section is embossed into the first edge of the second member, as achieved by a metal press brake, with the press brake in some instances perforating the first member at the point of embossing.

9 Claims, 3 Drawing Sheets

ROOFING TERMINATION DEVICE

The present invention relates to a device for terminating a roofing system at the edges thereof. More particularly, the present invention relates to a first member of relatively rigid material and a second member of relatively flexible material, the first and second members being joined along a common longitudinal edge by a waterproof joint. Even more particularly, the present invention relates to a roofing termination device which can serve as a parapet or vertical wall termination, a roof edge termination, a vertical flashing termination, an expansion joint, or other similar purposes.

BACKGROUND OF THE ART

The problem of terminating roof systems at the periphery of a roof, especially a rigid roof, in an easy and waterproof manner is a problem that has long plagued builders. As a result of this problem, the National Roofing Contractors Association has developed a Roofing and Waterproofing Manual setting forth standards by which roofs should be terminated. For example, the third edition of that work (published 1989) suggests the use of multiple layers of materials to achieve a waterproofing effect.

It is known that a metallic termination or flashing strip can be attached by conventional fasteners, such as screws, nails or rivets to the roof deck. However, since such fasteners necessarily penetrate the roof structure, they provide a site for water leakage, requiring further coverage of the fastener site. Conventional roofing practice would be to overcoat the penetration sites with waterproof mastic or the like. For example, U.S. Pat. No. 4,619,100 to Emblin, indicates that to further ensure the watertight integrity of the system, a secondary sealant layer is applied over the mechanical fastening screws and the overlapping edges of the adjacent skin sections. Emblin suggests that an area extending several inches from either side of the overlapping area be first brushed with a coat of fibrous plastic sealant material such as the commercially available "Plasticoat Sealant" produced by Elixir Industries, after which a membrane is applied over the sealant layer and a second layer of "Plasticoat Sealant" is then applied over membrane as shown.

While such a technique is effective, it makes removal of the roofing system for replacement, which is an almost inevitable occurrence, a difficult and labor intensive task. Additionally, this redundant utilization of material occurs with, at best, uncertain result.

SUMMARY OF THE INVENTION

It is, therefore, an object of the present invention is to provide a device for terminating a roofing system at the edges of the roof by sealingly connecting the roofing system to the building on which the roofing system is deployed in a fashion such that the fasteners utilized are situated in a waterproof manner, but are readily accessible, with the exposed vertical surface being able to withstand climatic effects.

This and other objects of the present invention are provided by a device for terminating a roofing system at an edge of a roof of a building, comprising a first member and a second member. The first member has a first and a second end, separated by a length dimension, and also has first and second edges, which run longitudinally along the member and are separated by a width dimension with each edge parallel to the length dimension. The second member is formed of a flexible material. It has a first and a second end, the ends being separated by a length dimension. It also has first and second edges, being separated by a width dimension with each edge parallel to the length dimension. The first edge of the second member is sealed in an airtight and watertight manner in a channel formed longitudinally along the first member near the first edge thereof such that the second member flexibly covers and extends beyond the first edge of the first member, which is adapted for attachment to the roofing system by fastening means. The second edge and the ends of the second member are adapted for airtight and watertight adhesion to a top surface of the roofing system and the second edge of the first member are adapted for attachment to the building. They are further situated for multi-directional movement preventing water intrusion below the roof surface.

The preferred first member is formed from sheet metal, especially zinc or zinc/aluminum alloy coated metal of about 26-gauge thickness or 0.24 inch thick aluminum.

The preferred second member is formed from modified bitumen material suitable for manufacturing shingles or an elastomer, particularly a vulcanizable elastomer such as EPDM.

In the preferred device the channel in the first member is formed by a first and a second longitudinal bend, which are made in opposite directions such that a "Z" shape cross section is formed, with the first edge extending outwardly from the second bend beyond the first bend. With this device, the airtight and watertight seal at the channel is formed by overlaying the first edge of the second member with a sealing material, inserting the first edge into the channel and sealing the first edge into the channel by applying pressure to the channel, with a device such as a sheet metal press brake.

In one embodiment, the second edge of the first member is attached by fastening means to a upwardly-extending vertical wall along the edge of the roof or is unattached and the second edge of the first member is partially concealed by an overlapping device, such as a wall cap, counterflashing, or similar device. In another embodiment, the second edge of the first member is attached by interconnecting means to a downwardly-extending receiving cleat along the edge of the roof. In a yet third embodiment, the device further comprises a third member, formed of a flexible material, preferably the same flexible material as the second member. This third member has a first and a second end, being separated by a length dimension, and having first and second edges, being separated by a width dimension with each edge parallel to the length dimension. The first edge of the third member is sealed in an airtight and watertight manner in a channel formed along the first member near the second edge thereof such that the third member flexibly covers and extends beyond the second edge of the first member, which is adapted for attachment to the roofing system by fastening means and the second edge of both the second and the third members are adapted for airtight and watertight adhesion to a top surface of the roofing system. In the preferred embodiment of this third embodiment, the third member is identical in size, thickness and material to the second member and the method of attaching the third member to the first member is identical to that used to attach the second member to the first member. In the most preferred embodiment of this third embodiment, the first member has a longitudinal expansion joint formed between the first and second edges thereof and the device has utility as an expansion joint on a roofing system.

BRIEF DESCRIPTION OF THE DRAWINGS

The present invention will be better understood when reference is made to the accompanying drawing sheets, wherein identical reference numerals are used to refer to identical parts and wherein.

DETAILED DESCRIPTION OF THE DRAWINGS

Figure 1:
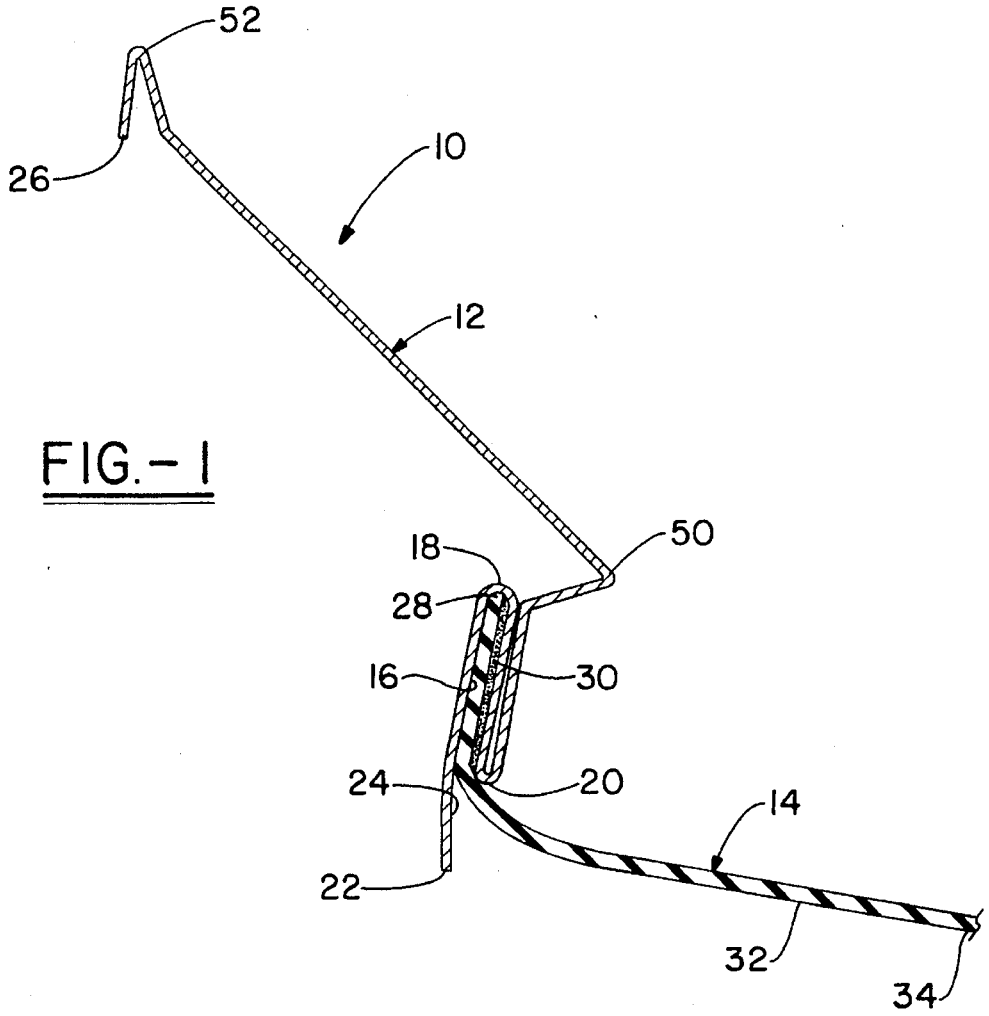
FIG. 1 shows a first embodiment of the present invention in side cross-section view.

The preferred roof perimeter termination system of the present invention is shown in the accompanying drawings. FIG. 1 shows the formed device 10 of the present invention in side cross-section. The roof termination device 10 generally comprises two members: a first member 12 for providing a fastening surface for attachment to both the building and the roof; and a second member 14 for covering the fastening surface formed between the first member and the roof in a waterproof manner. In the preferred embodiments, the first member provides a waterproof flashing for vertical termination between the building and the roof.

The first member 12 will typically comprise a metallic material, particularly a sheet metal suitable for roofing use. Continuous coil metal is especially useful for this service, with 26-gauge galvalume or galvanized steel or 0.24 inch aluminum sheet being commonly used. This combination of metal thickness and composition provides a reasonable compromise of structural rigidity with fabrication flexibility, and persons possessing ordinary skill in this art will readily be able to select an appropriate combination of metal and thickness. Usually, such product is supplied to a building site in coil form and is cut to size and formed in known metal bending equipment at the site, since the material is generally more easily transported in the unformed coil. In certain situations, however, the device 10 of the present invention may be pre-formed at the factory without affecting the novel aspects of the device. Starting from an elongate strip of the metal, preferably a rectangular elongate strip, the finished first member 12 is formed by a series of longitudinal bends to the material. Of these bends, the critical bending of the strip is in the formation of the channel 16 for receiving the second member 14 in an airtight and watertight seal.

The channel 16 for receiving the second member 14 is formed by a pair of longitudinal bends 18,20 of the first member 12 upon itself to effectively form the "Z" shape shown in FIG. 1. The first bend 18 must be along a bend line far enough into the metal from the first edge 22 to provide both the channel 16 and a fastening surface 24 which extends outwardly from the channel. In practice, the fastening surface 24 should be at least one inch wide along the length of the first member 12, and some applications would mandate the fastening surface to be several inches wide. The channel 16 should also be at least one inch deep and could be several times deeper in some applications. The first bend 18 is formed by folding the first member 12 back on itself along the longitudinal first bend line.

The second bend 20 completes the "Z" shape structure of the channel 16. This second bend 20 is made along a bend line positioned further into the first member 12 from the first bend line. The distance from the first bend line to the second bend line should be equal to the desired depth of the channel 16. The second bend 20 is a folding of the first member 12 back upon itself in the opposite direction of the first bend 18. While the bends 18,20 are described as being "first" and "second" bends, the respective bends are not required to be made in this order, and they can be made in the reverse order without affecting the utility of the inventive device 10.

When the first and second bends 18,20 are completed, the "Z" shape structure of the channel 16 will be internal to the first member 12 so that the first edge 22 and the fastening surface 24 associated therewith extends outwardly along the bottom horizontal leg of the "Z" and the second edge 26 and body of the first member extend outwardly along the top horizontal leg of the "Z". Final shaping of the various implementations of the inventive device 10 may be effected by further bends to the first member 12. Generally speaking, these bends may be made either before or after the bends for forming the "Z" shape channel.

Attention is now directed to the flexible second member 14. This member is an elongate strip of a flexible sealing material. In some embodiments, the material will be a polymer-modified bitumen material such as that frequently used in manufacturing shingles or BUR surfacing membranes. In another embodiment, the material will be a polymerized elastoplastic material such as an ethylene propylene terpolymer, such as is commercially available. This ethylene propylene terpolymer is referred to generically as "EPT" or "EPDM." It typically comprises an elastomer based on ethylene, propylene and small amounts of a non-conjugated diene such as hexadiene, dicyclopentadiene or ethylidene norbornene. In such an elastomer, the unsaturated portions of the molecule pend outwardly from the backbone of the molecule, which is saturated. As a result, the elastomer may be vulcanized. Such an elastomer, once vulcanized, exhibits excellent resistance to ozone, acids and alkalis and maintains its properties over a wide range of temperatures. While there is certainly considerable latitude in the selection of a proper second member material from the large number of possible materials, the major consideration beyond chemical resistance and retained flexibility under temperature extremes is compatibility with the roof covering that will be used.

Again referring to FIG. 1, the roof termination device 10 of the present invention is formed by inserting a longitudinal edge 28 of the second member 14 into the channel 16. A suitable adhesive material is coated onto at least one of the surfaces of the edge 28 prior to insertion into the channel 16. The adhesive is selected for compatibility with the metal and the flexible material of the second member 14. A typical adhesive is a modified poly(isobutylene) material that is commercially available, and those having skill in the roofing art will be able to readily select an appropriate adhesive. Once the edge 28 of the second member 16 is inserted into the channel 16, the channel itself should be pressed in a sheet metal press brake or similar device to compress the channel and effectively seal the second member 14 into the channel. Although FIG. 1 shows adhesive material 30 on only the top surface of the edge 28 of the second member 14, it will be prudent in some applications to apply adhesive to both the top and bottom surfaces of the edge 28 before inserting the edge into the channel 16 for sealing with the compression device.

As is shown clearly in FIG. 1, the second member 14 is wide enough that it may be inserted into the channel 16 and yet still retain sufficient free material to not only cover the fastening surface 24 of the first member 12, but extend out beyond the fastening surface so that the underside 32 of the second member, particularly the underside adjacent the second edge 34 thereof, may be adhered directly to the roofing system 100, as shown in the subsequent figures. This direct adhesion may be achieved in a variety of manners, including hot-applied asphalt, hot-applied adhesive, cold-applied adhesive, or pressure-sensitive adhesive sealant strip. The leading edge 34 of the flexible second member 14 may then be further sealed by application of a similar variety of sealing means.

Figure 2:
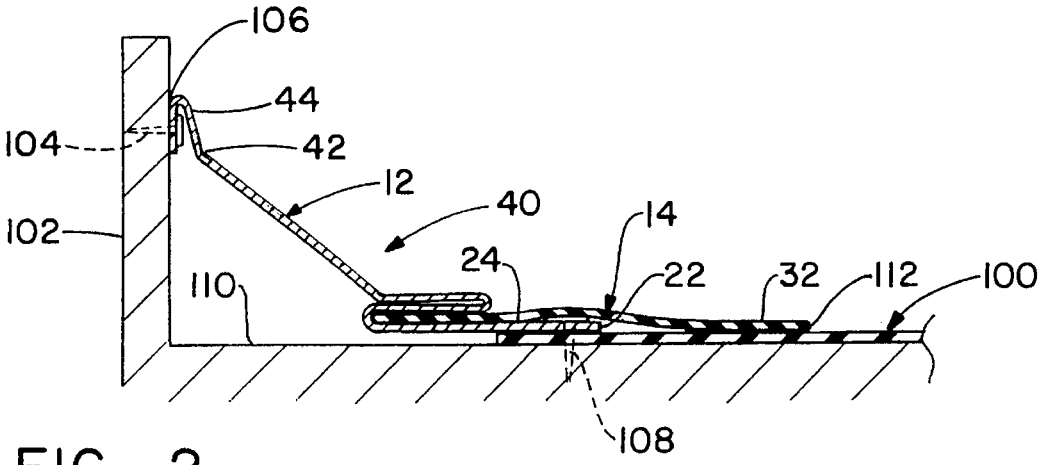
FIG. 2 shows a second embodiment of the present invention in side cross-section view, operatively engaged with a roofing system.

Attention is now directed to particular applications of the device 10 of the present invention with different roofing situations. In the embodiment 40 shown in FIG. 2, the device is adapted for termination of a roofing system 100 against an upwardly-extending parapet wall 102 along the edge of the roofing system. In this embodiment 40, which is shown in a side cross-section view, the device has had the second edge 42 of the first member 12 bent or formed into an essentially "V" shape channel 44 running longitudinally along the device to provide a flat surface for affixing the device to the parapet wall 102. In practice, it would be common to interpose a strip of compressible sealant material, particularly one having an elastomeric nature, between the flat surface and the wall and to use conventional fastening means 104, such as screws, nails or the like. A final secondary application of a sealant, especially a liquid sealant, along the junction line 106 created between the flat surface and the wall 102 is customary, but may be omitted in certain applications. Once the second edge 42 of the first member of the device 40 is so adhered, the first edge 22 is also fastened, again using conventional fastening means 108, such as the nail shown in FIG. 2 or a screw. While performing this step, the flexible second member 14 is flexed upwardly away from the first edge 22, exposing fastening surface 24, as is shown in FIG. 1 The fastening means 108 will penetrate not only the fastening surface 24 and the underlying roofing surface 100, but it will also penetrate into and be received in the roofing system support structure 110. After the first edge 22 is so affixed along the length of the fastening surface 24, flexible second member 14 is laid back down over the fastening surface as shown in FIG. 2 and the underside of the exterior edge 32 and ends thereof are adhered to the roofing surface 100. Additional sealant treatment at the junction line 112 between the edge 32 of the second member and the roofing system 100 may or may not be done, at the installer's preference.

Figure 3:
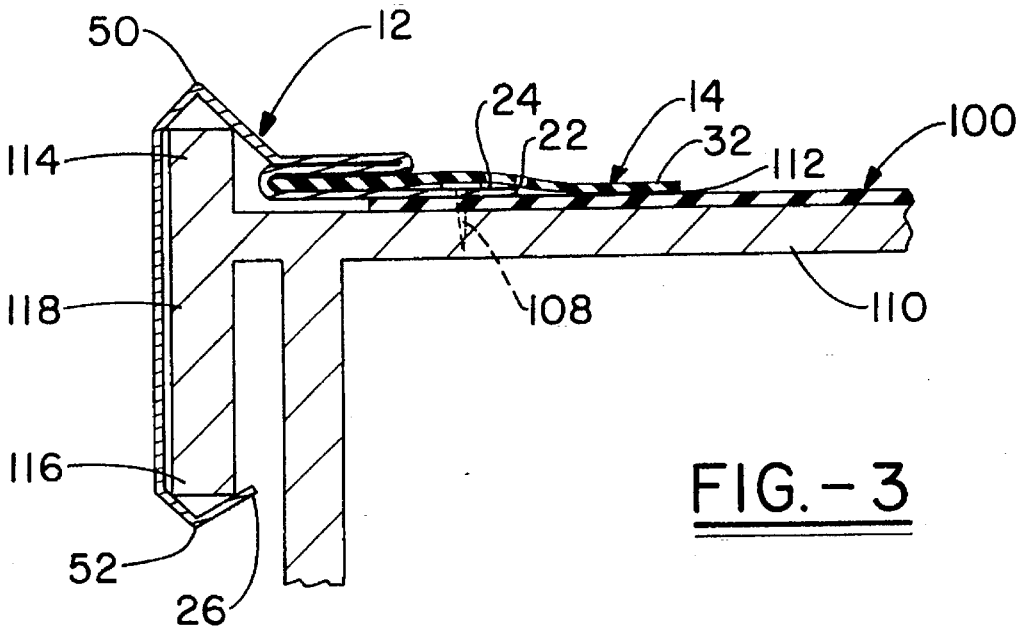
FIG. 3 shows the first embodiment of the present invention in side cross-section view, operatively engaged with a roofing system.

FIG. 3 shows a side cross-section view of the use of the device 10 of FIG. 1 for terminating a roofing system 100 against a roof edge 114. In this embodiment, a first "V" shape channel 50 has been formed near the "Z" shape joint and a second "V" shape channel 52 has been formed near the second edge 26 of the first member. As shown in FIG. 3, the first of these "V" shape channels 50 extends over the roof edge 114 and the second 52 is used to affix the device 10 to the edge cap 116. In addition to the second "V" shape channel 52, conventional fastening means and/or adhesives can be used along the exterior vertical wall 118. While not shown in the Figures, the "V" shape channels 50, 52 could be "L" shape to accommodate the particular roof geometry encountered without affecting the utility of the invention. Once the second edge of the first member of the device is so adhered, the first edge is also adhered, again using conventional fastening means 108, such as the nail shown in FIG. 3. While performing this step, the flexible second member 14 is flexed upwardly away from the first edge 22, exposing the fastening surface 24, as is shown in FIG. 1 The fastening means 108 will penetrate not only the fastening surface 24 and the underlying roofing surface 100, but it will also penetrate into and be received in the roofing system support structure 110. After the first edge 22 is so adhered along the length of the fastening surface 24, flexible second member 14 is laid back down over the fastening surface as shown in FIG. 3 and the underside of the exterior edge 32 and ends thereof are adhered to the roofing surface 100. Additional sealant treatment at the junction line 112 between the edges of the second member 14 and the roofing system 100 may or may not be done, at the installer's preference.

Figure 4:
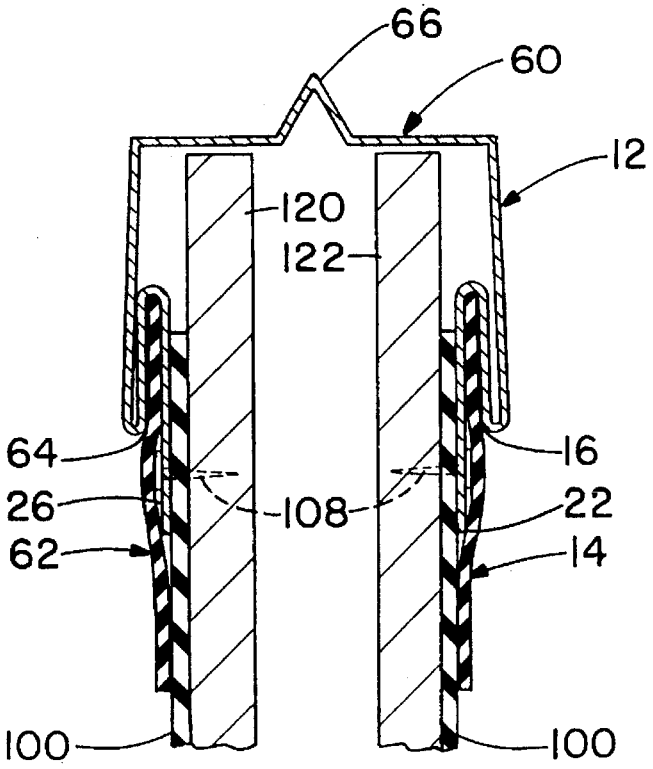
FIG. 4 shows a third embodiment of the present invention in side cross-section view, operatively engaged with a roofing system.

In a third embodiment 60 of the present invention, the second edge 26 of the first member 12 is formed similar to its first edge 22, so that a third member 62, formed of a flexible material, may be attached along the longitudinal channel 64, which is equivalent to the longitudinal "Z" shape channel 16 formed near the first edge. Such a device 60 embodying the present invention is shown in side cross-sectional view in FIG. 4. The intended use of this embodiment is to provide an expansion joint between two upwardly-extending walls 120, 122. The third member 62 will usually be identical to the second member 14, although it is quite conceivable that the third member will not be identical to the second member in some specific applications. When the device 60 is used as an expansion joint, there will be a longitudinal channel 66 formed intermediate to the first member to allow the necessary flexibility. In FIG. 4, this intermediate channel 66 is shown as being a "V" shape, but it will be readily understood that other shapes are equally facile in permitting expansion. In a mode similar to that described above, the device 60 is attached to the upwardly-extending walls 120, 122 to form an expansion joint by first joining one edge of the first member 12 and then the other to the adjacent walls. While performing these steps, the flexible member 14 or 62 forming that part of the joint is flexed upwardly away from the edge 22 or 26, exposing the respective fastening surface, as is shown in FIG. 1 The fastening means 108 will penetrate not only the fastening surface and the underlying surface, but it will also penetrate into and be received in the support structure. After a first edge 22 of the first member 12 is so adhered along the length of its fastening surface, the flexible member 14 or 62 is laid back down over the fastening surface as shown in FIG. 3 and the edges and ends thereof are adhered to the roofing surface. Additional sealant treatment at the junction line between the edges of the second member and the roofing system may or may not be done, at the installer's preference.

Figure 5:
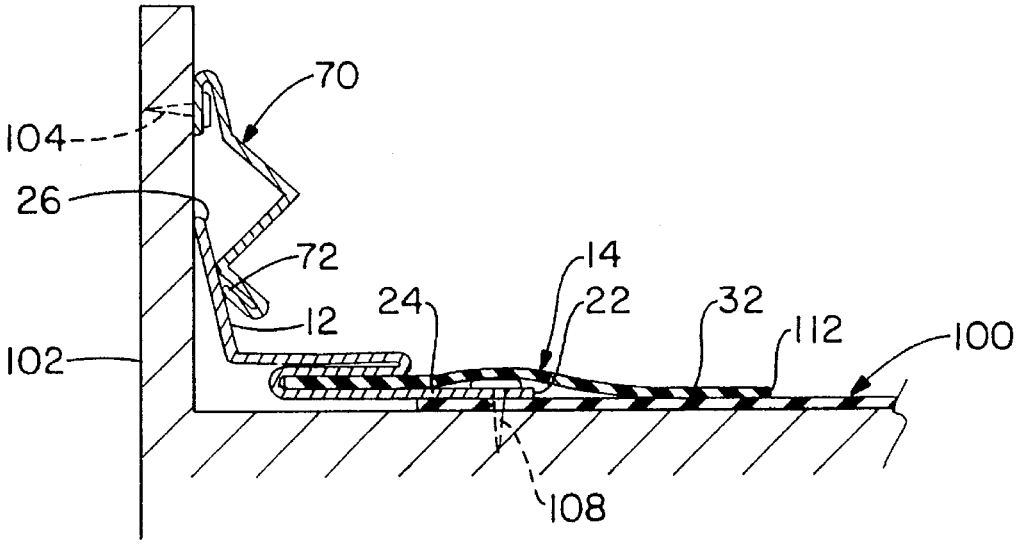
FIG. 5 shows a fourth embodiment of the present invention in side cross-section view, operatively engaged with a roofing system.

A yet further embodiment of the present invention is shown in FIG. 5, wher, instead of directly affixing the device to the wall 102 with fastening means 104, the device is constrained against the wall in waterproof manner by an overlapping member 70, which is affixed to the wall 102 before the insertion of end 26 under end 72. Other structures of the invention remain the same.

In any of the above applications of the present invention, it will be understood that the removal of the roof termination device can be effected quickly and efficiently. By slitting the flexible member or members at the point where they overlie the fastening surface, the fasteners are exposed and may be removed by conventional means. Once this first edge of the first member is removed from the roofing surface, the fasteners used in association with the second edge of the first member are also exposed and may be removed. If properly applied, the fasteners are not coated with or embedded in mastic or the like.

Figure 6:
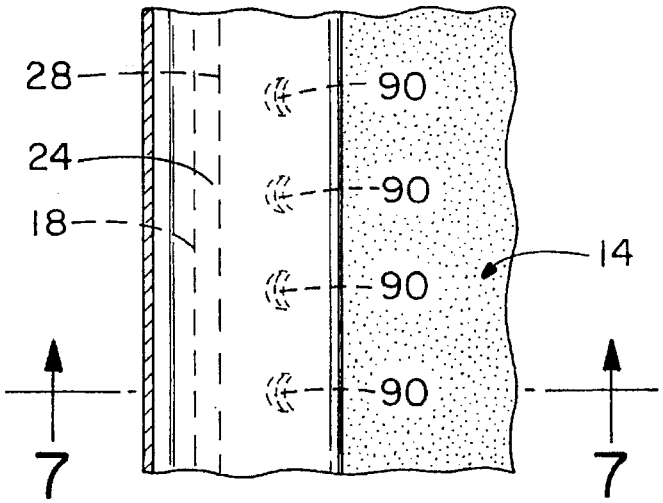
FIG. 6 shows a bottom view of the present invention.
Figure 7:
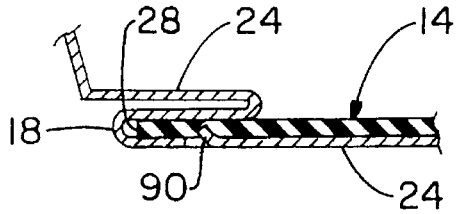
FIG. 7 shows a side cross-section view, taken along Line 7—7 in FIG. 6.

In some applications of the present invention, it will be preferred to strengthen the joint between the first and second members while pressing the "Z" shape bend in the first member while it contains the second member and the adhesive. In one such situation, as shown in FIGS. 6 and 7, the sheet metal press brake used to seal the second member 14 in channel 16 by compressing first member 12 may have raised portions which will emboss or press a portion 90 of the first member, particularly the portion immediately below the first edge 28 of the second member, into the first edge of the second member. FIG. 7 shows one such embossed portion 90 in side view as seen along Line 7—7 in FIG. 6. In this specific embodiment, the metal press brake will make semicircular perforations into the first member and drive these into the second member. In other embodiments, the surface of the first member will be embossed in an imperforate manner into the second member. This technique is particularly effective when the perforations are oriented as shown in the FIG., so that any outward movement of the second member from the joint is restrained by the raised portions of the first member. These raised portions will preferably be regularly spaced along the length of the joint.

The foregoing specification includes the preferred embodiment of the invention and the best mode known for practicing the invention as of the filing date hereof, but the scope of coverage of the invention is set forth not by the foregoing specification, but rather by the following claims, from which the scope of the invention may be determined.

What is claimed is:

1. In combination with a roofing system consisting of a roofing membrane, a roofing system support structure and a vertical termination of a roof of a building, an improved device for terminating the roofing system at said a vertical termination of a the roof said improved device comprising:

a first member, having a first and a second end, said ends separated by a length dimension, and having first and second edges, said edges separated by a width dimension with each edge parallel to the length dimension;

a second member, formed of a flexible material, having a first and a second end, said ends separated by a length dimension, and having first and second edges, said edges separated by a width dimension with each edge parallel to the length dimension;

the first edge of the second member being sealed in an airtight and watertight manner in a channel formed longitudinally along the first member near the first edge thereof such that the second member flexibly covers and extends beyond the first edge of the first member, which is attached to the roofing system support structure by fastening means;

the second edge and the ends of the second member being adhered in an airtight and watertight manner to a top surface of the roofing membrane; and the second edge of the first member being attached to the building at the vertical termination of the roof.

2. The device of claim 1 wherein the first member is formed from sheet metal.

3. The device of claim 1 wherein the second member is formed from modified bitumen material.

4. The device of claim 1 wherein the second member is formed from EPDM.

5. The device of claim 1 wherein the channel in the first member is formed by a first and a second longitudinal bend, the first and the second longitudinal bends being made in opposite directions such that a "Z" shape cross section is formed, with the first edge extending outwardly from the second bend beyond the first bend.

6. The device of claim 5 wherein the airtight and watertight seal at the channel is formed by overlaying the first edge of the second member with a sealing material, inserting the first edge into the channel and sealing the first edge into the channel by applying pressure to the channel.

7. The device of claim 6 wherein at least one portion of the first member near the first bend forming the "Z" shape cross section is pressed into the first edge of the second member.

8. The device of claim 1 wherein the second edge of the first member is attached by fastening means to an upwardly-extending parapet wall along an the edge of roof.

9. The device of the claim 1 wherein the second edge of the first member is attached by fastening means to a downwardly-extending wall cap along the edge of the roof.

* * * * *